United States Patent [19]

Iwasa et al.

[11] Patent Number: 4,715,819

[45] Date of Patent: Dec. 29, 1987

[54] CONNECTOR FOR PRINTED BOARD CONNECTION

[75] Inventors: Yoshihiro Iwasa; Toru Masuda; Yasuji Shibano, all of Osaka, Japan

[73] Assignee: Hosiden Electronics Co., Ltd., Japan

[21] Appl. No.: 898,780

[22] Filed: Aug. 19, 1986

Related U.S. Application Data

[63] Continuation of Ser. No. 721,511, Apr. 9, 1985, abandoned.

[30] Foreign Application Priority Data

Apr. 12, 1984 [JP] Japan ..... 59-54614[U]

[51] Int. Cl.[4] ..... H01R 39/00

[52] U.S. Cl. ..... 439/31; 439/65

[58] Field of Search ..... 339/17 L, 17 M, 17 LM, 339/17 LC, 75 MP, 4, 6 R, 6 A, 8 R, 8 A; 439/13, 31, 65, 74, 326, 329

[56] References Cited

U.S. PATENT DOCUMENTS 3,601,746 8/1971 Teagno ..... 339/4
3,701,071 10/1972 Landman ..... 339/17 M X
4,527,848 7/1985 Velsher et al. ..... 339/17 M
4,632,475 12/1986 Tomita ..... 339/4

OTHER PUBLICATIONS

"Pivot Connector", Schulz, IBM Tech. Discl. Bull., vol. 6, No. 3, p. 79, Aug. 1963.

*Primary Examiner*—Eugene F. Desmond
*Attorney, Agent, or Firm*—Jones, Tullar & Cooper

[57] ABSTRACT

This invention discloses a connector for printed board connection comprising a first body having a plurality of first contacts to be connected with one printed wiring and a second body facing to the first contacts of the first body, in which the first body and the second body are turnably and detachably connected with each other, each end of the first contacts and each end of the second contacts are brought into contact with each other within a turning range, so that the printed boards may be easily and speedily connected with each other and that the arrangement of the printed boards may be freely selected while electrical connection therebetween being assured, maintenance being easily carried out and cost being saved thereby.

13 Claims, 29 Drawing Figures

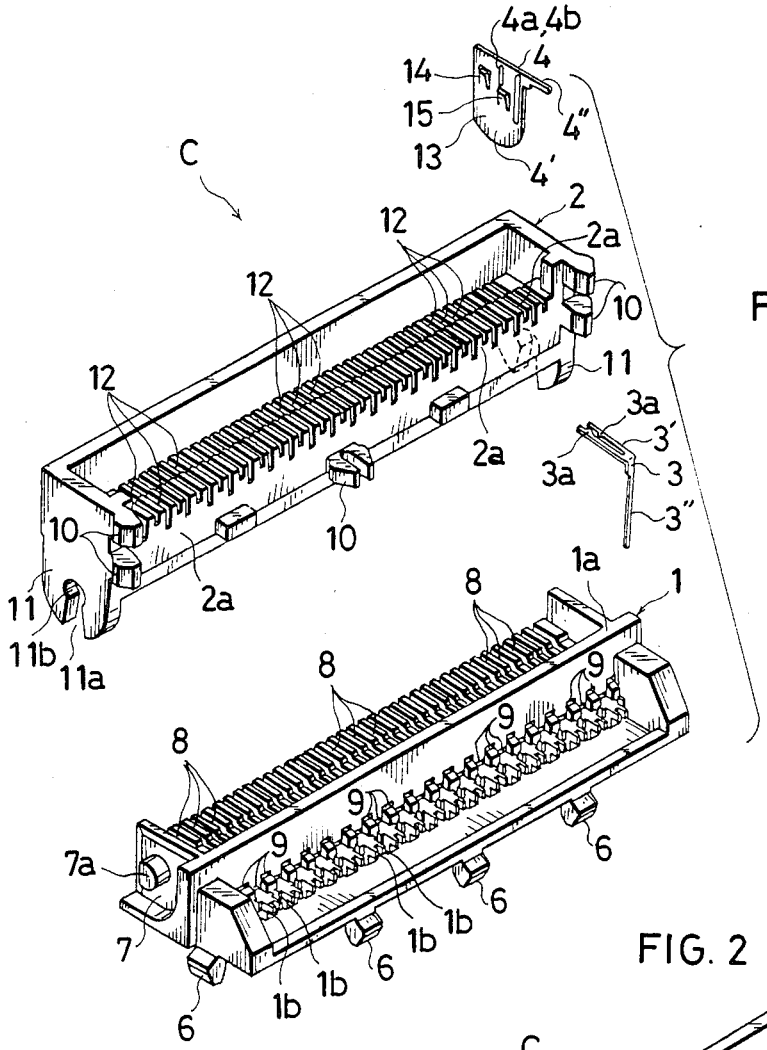
FIG. 1
FIG. 2
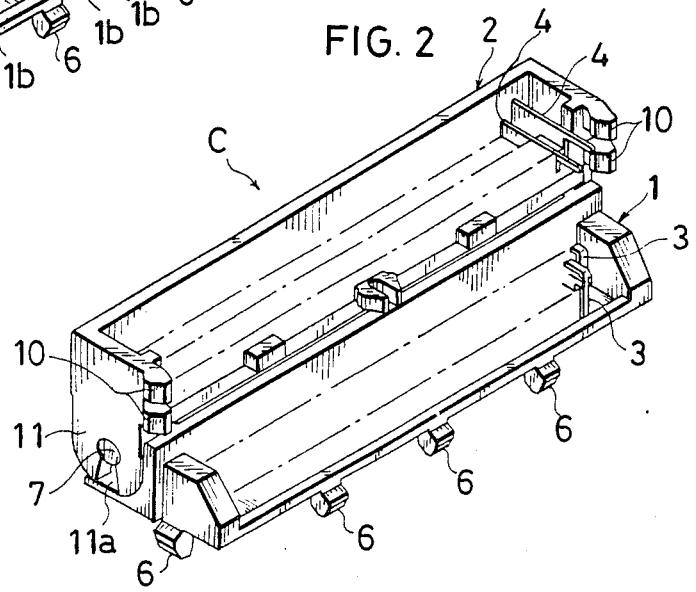

CONNECTOR FOR PRINTED BOARD CONNECTION

This is a continuation of co-pending application Ser. No. 721,511 filed on Apr. 9, 1985, now abandoned.

BACKGROUND OF THE INVENTION

This invention relates to a connector for printed board connection to be used in connecting a printed wiring of one printed board with a printed wiring of another printed board.

It is recent tendency that such light electrical appliance as VTR, audio system or the like is so arranged as to be compact. Accordingly, in order to use space in the appliance as effective as possible, it is often the case to connect one printed board with another in an orthogonal arrangement.

According to the known method for connecting such printed boards orthogonal to each other, receptacles are provided on both of the printed boards orthogonal to each other respectively, and electrical connection is perfomed by inserting each plug provided at both ends of a flat cable into each receptacle.

In the case of such a connection, however, a large number of receptacles, plugs and flat cables are necessary as compared with an ordinary connector (comprising a pair of plug and receptacle), resulting in a disadvantage of increasing the number of components or parts.

Furthermore, according to such a conventional connection, when a large number of contacts are arranged in the receptacles as is the case of a VTR, it is necessary to insert each plug of flat cables into each contact of the orthogonal receptacles for the connection therebetween, which is quite troublesome work causing lowering of productivity in the mass production thereof.

That is, since a large number of plugs and wires are necessary when manufacturing the flat cables, the number of parts is increased, and besides since these large number of plugs and wires must be connected one by one, such connecting work is very hard, eventually increasing the production cost.

SUMMARY OF THE INVENTION

An object of this invention is therfore to provide a connector for a printed board connection by which when arranging printed boards orthogonal to each other or at a specified angle, the printed wiring therebetween is easily and speedily connected.

Another object of this invention is to provide a connector for a printed board connection by which the number of parts is decreased, and in association with the easy and speedy connection, the manufacturing cost thereof is saved.

A further object of this invention is to provide a connector for a printed board connection by which even in case of arranging printed boards orthogonal to each other or at a specified angle, circuit maintenance, printed wiring, etc. can be simply carried out.

A still further object of this invention is to provide a connector for a printed board connection by which electrical connection is held exactly and stably.

A yet further object of this invention is to provide a connector for a printed board connection by which the printed boards are arranged orthogonal or at a specified angle, and besides the arrangment of the copper foil surface of each printed board can be selective.

An additional object of this invention is to provide a connector for a printed board connection which is greatly compact in comparison with the conventional connectors.

Other features and advantages of this invention will become apparent in the course of the following description of the preferred embodiment with the accompanying drawings.

BRIEF DESCRIPTION OF THE DRAWINGS

In the accompanying drawings forming a part of this application,

FIG. 1 to FIG. 8 show a first embodiment of this invention, and wherein;

FIG. 1 is a perspective view showing a first body, a second body, a first contact and a second contact;

FIG. 2 is a schematic perspective view of a connector for a printed board connection in the assembling state;

FIG. 3 is a side view of the connector for a printed board connection of which the second body is in the erected state;

FIG. 4 is a side view of the connector for a printed board connection of which the second body is in the lying state;

FIG. 5 is a sectional view of the connector for a printed board connection in which a lower erecting piece of the second contact is held on the lower side of the second body;

FIG. 6 is a sectional veiw of the connector for a printed board connection in which cut-and-raised pieces of the second contact are held on the lower side of the second body;

FIG. 7 is a sectional view of the connector for a printed board connection of which a second body is in the lying state;

FIG. 8 is an outline of the first body viewed from the back side thereof;

FIG. 9 to FIG. 16 show a second embodiment of this invention, and wherein;

FIG. 9 is a perspective veiw of a connector for a printed board connection;

FIG. 10 is an exploded perspective view of the first body and the second body of the connector for a printed board connection;

FIG. 11 is a sectional side view of the connector for a printed board connection;

FIG. 12 is a side view of the first body;

FIG. 13 is a sectional side view of the first body;

FIG. 14 is a sectional side view in which the first body is coupled with the second body;

FIG. 15 is a sectional view showing a front side of the second body;

FIG. 16 is a sectional side view in which the first contacts adjacent to each other are displaced from each other in the vertical direction as well as in the longitudinal direction;

FIG. 17 to FIG. 23 show a third embodiment of this invention, and wherein;

FIG. 17 is a schematic view of the front side of the second body;

FIG. 18 is a sectional view taken along the line XVIII—XVIII of FIG. 17;

FIG. 19 is a schematic view of the front side of the first body;

FIG. 20 is a sectional view taken along the line XX—XX of FIG. 19;

FIG. 21 is a sectional side view in which the first body is coupled with the second body while the printed board being disposed on the lower side of the first body;

FIG. 22 is a sectional side view in which the first body is coupled with the second body while the printed board is disposed on the upper side of the first body;

FIG. 23 is a sectional side view in which the first body is coupled with the second body at an angle of 60°;

FIG. 24 to FIG. 29 show a fourth embodiment of this invention, and wherein;

FIG. 24 is a schematic view of the front side of the second body;

FIG. 25 is a sectional veiw taken along the line XXV—XXV of FIG. 24;

FIG. 26 is a schematic view of the front side of the first body;

FIG. 27 is a sectional view taken along the line XXVII—XXVII of FIG. 26;

FIG. 28 is a sectional side view in which the first body is coupled with the second body while the printed board is disposed on the lower side of the first body; and FIG. 29 is a sectional side view in which the first body is coupled with the second body while the printed board is disposed in the upper side of the first body.

DETAILED DESCRIPTION OF THE PREFERRED EMBODIMENTS

Referring now to the accompanying drawings several embodiments of this invention are described in detail hereinafter. The first embodiment is shown in FIG. 1 to FIG. 8, the second embodiment in FIG. 9 to FIG. 16, the third embodiment in FIG. 17 to FIG. 23, and the fourth embodiment in FIG. 24 to FIG. 29, respectively.

Figure 3:
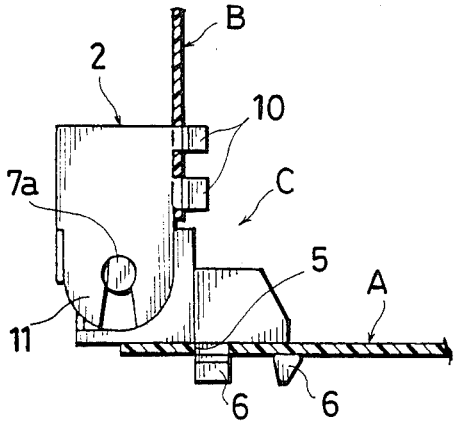
Figure 4:
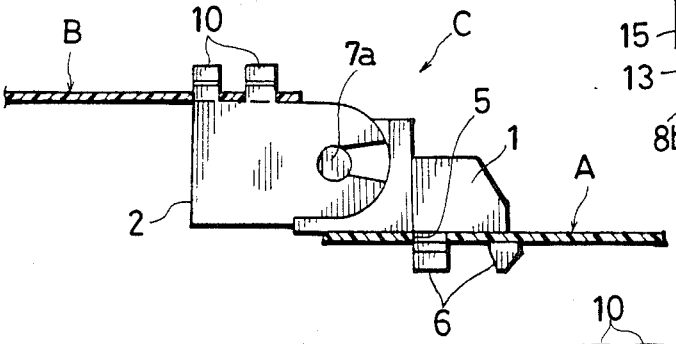

First embodiment:

In FIGS. 3 and 4, reference characters A, B are printed boards disposed so as to be orthogonal to each other, C is a connector for a printed board connection provided on each end of these orthogonal printed boards for connecting printed wirings of each printed board A, B with each other.

The connector C for the printed board connection comprises a first body 1 of synthetic resin and a second body 2 of the same material. The first body 1 is formed to be a rectangular parallelopiped as a whole and is fixed to the printed board A by engaging clicks 6 integrally provided so as to be projected from left and right sides of the lower face of the body 1 downward with corresponding perforations (not illustrated) provided on the printed board A. The second body is also formed to be a rectangular parallelopiped as a whole and is fixed to the printed board B by engaging clicks 10 integrally so as to be projected from the front side of the body 2 toward the first body 1 with corresponding perforations (not illustrated) of the printed board B.

An inserting groove the upper and front side of which is open is formed in both sides of the front half part of the first body 1 so that the arcuate angle of the groove may be 90°. A shaft member 7*a* projecting outward is formed at the center part of the arcuate angle of the inserting groove 7.

A semi-circular arcuate arm member 11 projecting toward the first body 1 (more specifically toward the inserting groove 7) is formed on both sides of the second body 2. Formed in the arm member 11 are an inserting aperture 11*a* from the top end toward the inside thereof so as to be narrowed gradually, and an engaging aperture 11*b* for engaging the shaft member 7*a* with the rear end of the inserting aperture 11a. The arm member 11 is turned on the shaft member 7*a* by 90° by pushing the shaft 7*a* in the engaging aperture 11*b* after inserting the shaft 7*a* through into the inserting aperture 11*a*. In this respect, the first body 1 is removed from the second body 2 by pulling out manually the shaft member 7*a* from the engaging aperture 11*b*.

Figure 5:
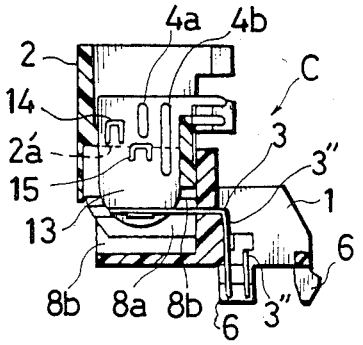
Figure 6:
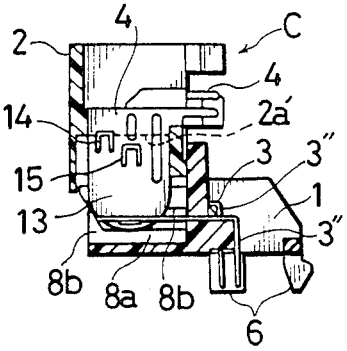
Figure 7:
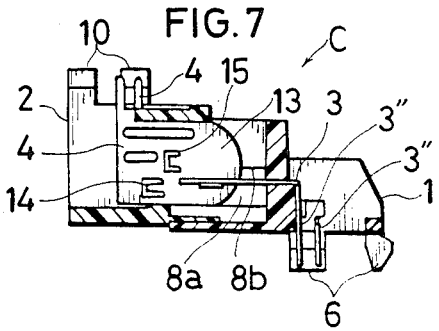
Figure 8:
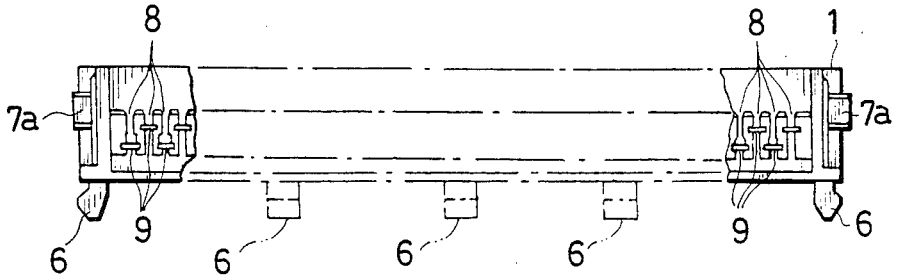

Further, in the first body 1, a bulk head 1*a* is formed over the full length thereof for the partition between the front half part and the rear half part of the body 1. A plurality of through grooves 9 passing through the partition 1*a* are formed in the direction (lateral direction) of width of the partition 1*a*. A plurality of grooves 8 each correspondingly communicated with the through grooves are provided in parallel of the front side of each through groove 9, i.e., at the part where the first body 1 faces to the second body 2. Each groove 8 comprises an accommodating part 8*a* for accommodating a fork-shaped contact member 3' of a first contact 3 later described and a spacing 8*b* which permits the top end of a plate-like contact member 4' of a second contact 4 later described to turn from above forward and to be inserted between (in the branched portion of) the fork-shaped contact member 3' accommodated in the accommodating part 8*a* as shown in FIG. 5 to FIG. 7.

In the second body, meanwhile, a plurality of grooves 12 are formed corresponding to the grooves 8 in the direction of width (lateral direction). The grooves 12 pass through from the upper side 2*a* to the bottom side 2*a*' as shown in FIG. 1 and 5.

The description of the first contact 3 and the second contact 4 is given below.

The first contact 3 is formed to have an inverted L-shape integrally comprising a fork-shaped contact member 3 arranged at the upper part and a lead part 3'' for connecting the wiring of the printed board A arranged at the rear end of the contact member 3' as shown in FIG. 1. Contact areas 3*a*, 3*a* of the contact member 3' are formed at the inner surfaces facing each other so that the position of each contact area may be displaced in the longitudinal direction as shown in FIG. 1. Further, these contact areas 3*a*, 3*a* are inclined downward respectively so that the top end of a plate-like contact member 4' of the second contact 4 later described may be easily inserted. The opposed interval of the contact member 3' is so arranged as to coincide substantially with the width of the interval 8*b* of the guide grooves 8 formed in the direction of width of the first body 1.

On the other hand, as shown in FIG. 1, the second contact 4 comprises a plate-like contact member the top end of which end is almost semi-circular, and a lead part 4'' solidly projected from the upper end of the contact member 4' toward the printed board B. Cut-and-raised pieces 14, 15 are formed by cutting a part of the second contact member 4' and bent to be raised on the contact member 4' each position thereof being displaced, and further projections 4*a*, 4*b* are formed on the outer surface of the contact member 4' for preventing the second contact 4 from looseness by press contact against the side of the bulk head 2*b* when inserted in the groove 12 of the second body 2.

In this manner, the first contact 3 is fixed to the first body 1 by inserting the top end of the contact member 3' of the first contact 3 in the through groove 9 from the back side thereof, accommodating the contact member 3' in the accommodating part 8*a* of the groove 8, and pushing the lead part 3" of the first contact 3 between a pair of holding parts 1*b*, 1*b* formed on the back side of the erected wall 1*a* to be held therebetween.

On the other hand, the second contact 4 is fixed to the second body 2 by pushing the top end of the contact member 4' of the second contact 4 in the upper side of each groove 12, projecting the top end from the under side 2*a* of the second body 4 downward to be exposed as shown in FIG. 5, and holding the cut-and-raised pieces 14, 15 of the second contact 4 on the lower side 2*a*.

In addition, the plural grooves 8, through grooves 9 and the holding members 1*b*, 1*b* formed on the first body 1 are displaced from one another in their vertical positions in relation to the adjacent one, and the pair of holding members 1*b*, 1*b* are further displaced in their holding position in the longitudinal direction, so that the fitting position of the lead part 3" of the first contact 3 to the printed board is prevented from being densely close (or jamming), in other words, for securing an easy fitting, as shown in FIGS. 5 to 7.

Furthermore, in the second contact 4, the vertical positional relation between the upper cut-and-raised piece 14 and the lower cut-and-raised piece 15 is changed whether the former piece 14 is held on the lower side 2*a*' of the second body 2 (FIG. 6) or the latter piece 15 is held on the bottom side 2*a*' of the second body 2 (FIG. 5) for securing sufficient contact with the contact member 3' of the first contact 3 of which vertical position is displaced and for preventing the lead part 4" of the second contact 4 from being densely close on the printed board B.

Thus, by the arrangement as described above, when the shaft member 7 of the first body 1 is engaged with the engaging aperture 11 of the second body 2, the top end of the plate-like contact member 4' of the second contact 4 is inserted between the contact member 3' of the first contact 3 accommodated in the accommodating part 8*a* through the interval 8*b* of the first body 1 to come in contact with the contact member 4' formed on the opposed side of the contact member 3'. Accordingly, the first contact 3 is in electrical contact with the second contact 4.

Since the second contact 4 is brought into contact with the first contact 3 only by coupling the second body 2 with the first body 1 so that the electrical contact between the first contact 3 and the second contact 4 is secured, the connecting work of each contact is quite easily and speedily carried out as compared with the conventional method of contact by flat cable.

Further, since the second body 2 is turnably and detachably arranged over the raised position and the lying position in relation to the first body 1, when these first and second contacts 3, 4 are in imperfect contact requiring repairs, or some circuit fixed to the wiring of the printed board is in failure, for example, the first body A and second body B can be simply disassembled, the failure part being easily found thereby. Thus, in the maintenance aspect, the connector according to this invention is far more convenient than the conventional connection using flat cable. In addition, in case of the conventional connection using flat cable, it is difficult to easily find out whether the flat cable itself gets out of order or the contact in the body does, and therefore there is difficulty in the trouble detecting work. Moreover, in the conventional connector, since the plugs at both ends of the flat cable are fixed by soldering and the contact in the body is included in the inner part of the body, the disassembling thereof is also very hard work. On the other hand, according to the above-described first embodiment, the first body 1 can be easily separated from the second body 2. Further, in the first contact 3 of the first body 1 as well as the second contact 4 of the second body 2, the contact members 3*a*, 4' thereof are exposed outside as shown in FIG. 1, so that the repair of these members can be simply and speedily carried out.

Furthermore, according to the foregoing first embodiment, since it is not necessary to use a component as flat cable for the electrical connection between the first and second contacts 3, 4, the number of necessary parts is decreased, and by virtue of this decrease in the number of parts as well as the above-described promotion of efficiency of the connecting work, the cost is considerably saved.

In addition, although in the above first embodiment the turning range of the first body 1 and the second body 2 is established to be from 0° (when the printed board B is in the horizontal state) to 90°, the invention is not limited thereto and it is also possible to arrange the turning range between 0° and 180°.

Figure 9:
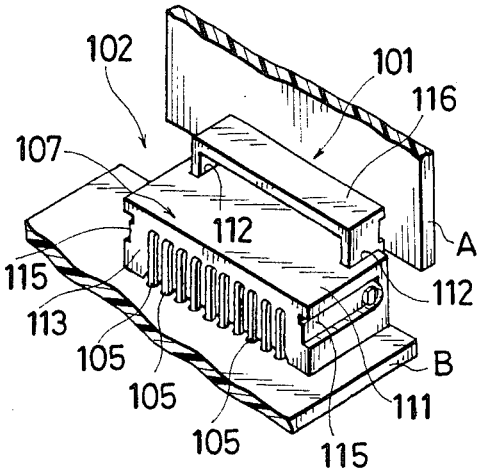
Figure 11:
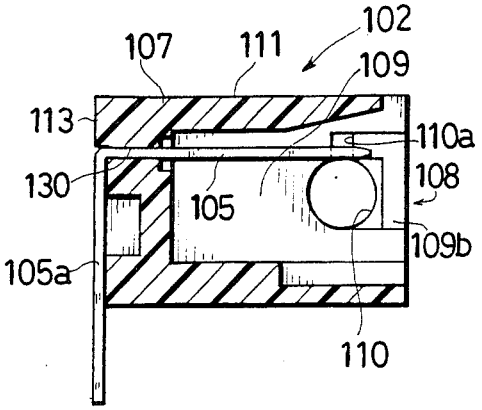
Figure 10:
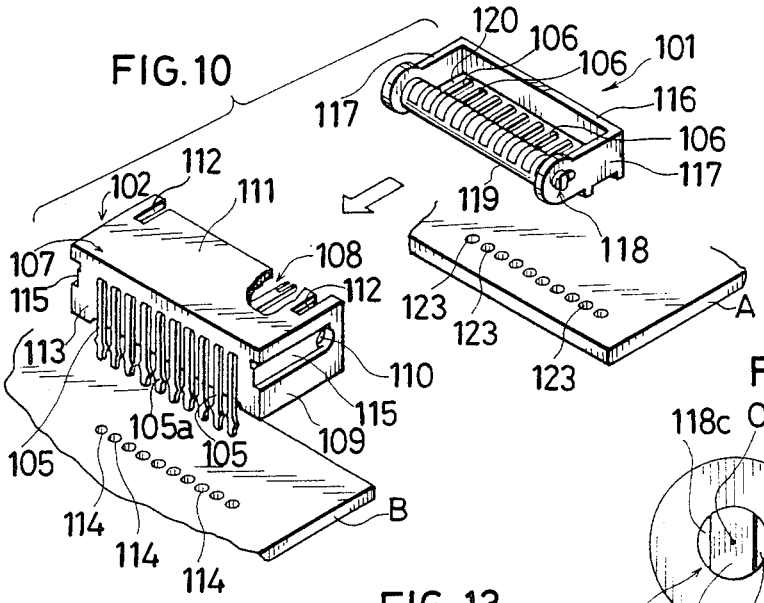

Second embodiment:

FIGS. 9 and 10 show a connector for a printed board connection, and wherein numeral 101 is a first body and 102 is a second body respectively fit to printed boards A and B, and a first contact 106 and a second contact 105 are electrically connected with each other.

A housing 107 of the second body 102 is formed to be a rectangular parallelopiped as a whole with its front side 108 open, and engaging apertures 110 are provided near the front ends of both sides 109 of the housing 107. Each engaging aperture 110 is keyhole-shaped having an expanding hole 110a on the upper part, and a tapered surface 109b reaching the aperture 110 and formed on the side 109 near the front side 108. Further, cutout portions 112 are formed on the housing 107 of the second body 102. In the example illustrated, the cutout portions comprise a pair of grooves formed near both ends of the upper side 111 and near the sides 109. A plurality of second contacts 105 formed by bending to be L-shaped are mounted on the housing 107 of the second body 102. In addition, the cutout portions 112 can be also formed to be square shaped on the upper side 111.

A half of the second contact body 105 setting the bent portion as boundary is accommodated in the inner part near the upper side 111 of the housing 107, the other half being exposed on the back side 113, and the top end of the exposed contact is inserted into each of a plurality of apertures 114 provided on the printed board B to be soldered there so that the second body 102 may be fixed to the printed board B and that the second contact 105 may be connected with a circuit arranged on the printed board B. The housing 107 and a housing 116 of the first body 101 described later are made of such synthetic resin as polybutyleneterephthalete. In addition, when forming the housing 107, a groove 115 is formed on each of the sides 109 for mold releasing.

Figure 12:
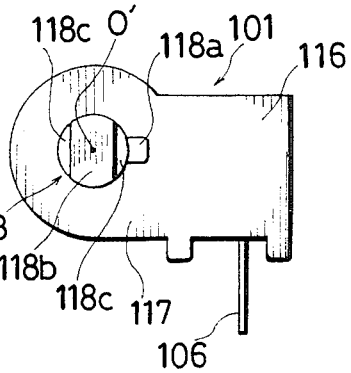
Figure 13:
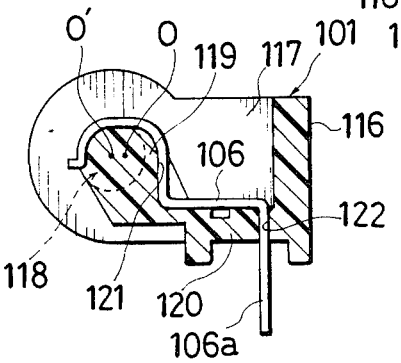
Figure 14:
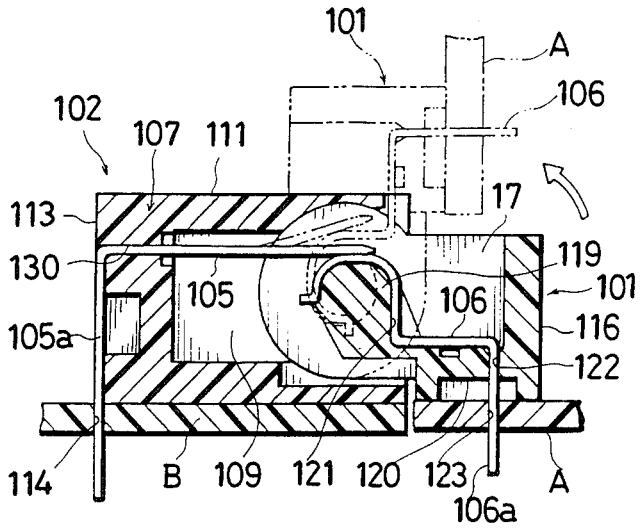
Figure 15:
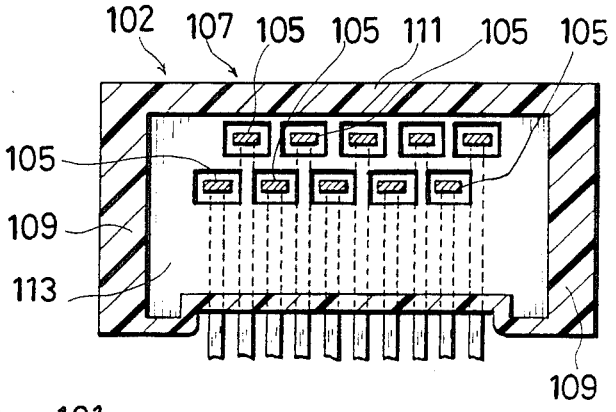
Figure 16:
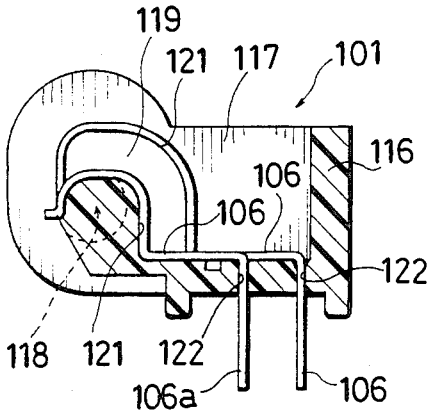

The housing 116 of the first body 101 has both sides 117 to be engaged detachably with the cutout portions 112 of the housing 107 of the second body, and at each top end portion of the sides 117, a shaft member 118 is projectingly provided to engage with the engaging aperture 110. As shown in FIG. 12, the shaft member 118 is formed to be keyhole-shaped having a projection 118*a* in the lateral direction corresponding to the engaging aperture 110, and the projection 118*a* is formed to be smaller than the shaft member 118*b*.

Further, a tapered surface 118*c* is formed on the shaft member 118*b* corresponding to the tapered surface 109*b* formed on the housing 107 of the first body as illustrated.

Numeral 119 is a projecting (or ridged) cam formed so as to couple the side 117, and has a bottom part 120 solidly connected therewith. The axial center position 0 of the projecting cam 119 is deviated or eccentric to the axial center position 0' of the shaft member 118 in the reverse direction to that for engaging the shaft 118 with the aperture 110 of the housing 107. In the projecting cam 119 and the bottom part 120, a plurality of grooves 121 are formed at a specified interval in the axial direction, and at the end of each groove 121 on the bottom side 120, an aperture 122 is provided. In the grooves 121, a plurality of bent first contacts 106 are inserted respectively as illustrated, each one end thereof is inserted in each aperture 122 and further press fitted into each of a plurality of apertures 123 formed on the printed board A to be fixed thereto by soldering and be connected with a circuit arranged on the printed board A.

With respect to the assembling of the first body 101 and the second body 102 arranged as above-described, in the first place the printed board B on which the second body 102 is mounted is held horizontal, while the printed board A on which the first body 101 is mounted is inserted horizontally in the front side 108 of the housng 107 of the second body, and the shaft member 118*b* is engaged with the engaging aperture 110 of the second body 102. In this state, the first body 101 is turnably connected with the second body 102, and a preload is applied to the part between the first contact 106 and the second contact 105. Further, both contacts 105, 106 are in contact with each other at the position of the projecting cam 119 as shown in FIG. 6.

Then, the printed board A (first body 101) is turned upwardly. At this time, the sides 117 of the first body 101 are engaged with the cutout portions 112 of the second body 102 and are kept in the erected state being turned by 90°. In this state, the top end of the second contact 105 is pushed upward by the projection cam 119 while being in contact with the second contact 106 as indicated by the imaginary line, thereby the contacts 105 and 106 are put in contact with each other under high pressure. In addition, the projection 118*a* is engaged with the aperture 110*a* so as not to be released or separated from each other. In this way the connector for the printed board connection of this embodiment is put in use. In case of checking the wiring of the circuit of the printed boards A, B, the printed board A (first body 101) is turned in the reverse direction to the operating direction. By the foregoing arrangement, the assembling becomes quite simple, the two contacts 106, 105 of the first body 101 and the second body 102 being easily and speedily connected with each other. Furthermore, since the first body 101 is turnable and detachable, such maintenance as inspection of the circuits of the printed boards A, B of the contacts 105, 106 is quite easily carried out in the same manner as the preceding first embodiment.

Moreover, when the first body 101 is turned by 90°, the contacts 105, 106 come in contact with each other under higher pressure than the time of coupling the body by the distance between the axial center 0 of the projecting cam 119 and that of the shaft member 118, and accordingly the problem of imperfect contact can be prevented as much as possible. Since the projection 118*a* of the first body 101 is engaged with the aperture 110*a*, the state of contact under high pressure is kept stable.

In addition, as a modification of this embodiment, it is also possible to adopt such an arrangement that the second contact 105 of the second body 102 is arranged to be staggered from having step difference vertically, while the first contact 106 of the first body 101 is disposed on the projecting cam 119 having irregularities corresponding to the second contact 105, so that the contacts 105, 106 may be effectively disposed in the limited space.

Further, in case of this embodiment, it is possible to insert together a plurality of punched first contacts arranged laterally and of which lead parts 106*a* are connected with each other into each aperture 122 of the first body 101 from the bottom side thereof to be mounted on the first body 101. In the same way, it is also possible to insert together a plurality of punched second contacts 105 arranged laterally with the lead parts 105*a* connected with each other into each groove 130 of the second body 102 from the back side thereof to be mounted on the second body 102.

Thus, the assembling of the contacts into the bodies are quite easily and speedily carried out, each punched contact can be incorporated or inserted together into the respective bodies, and it becomes possible to make each contact as well as each body small-sized. In addition, the connecting pieces for connecting the lead parts with each other can be cut off after being assembled into the bodies.

Figure 17:
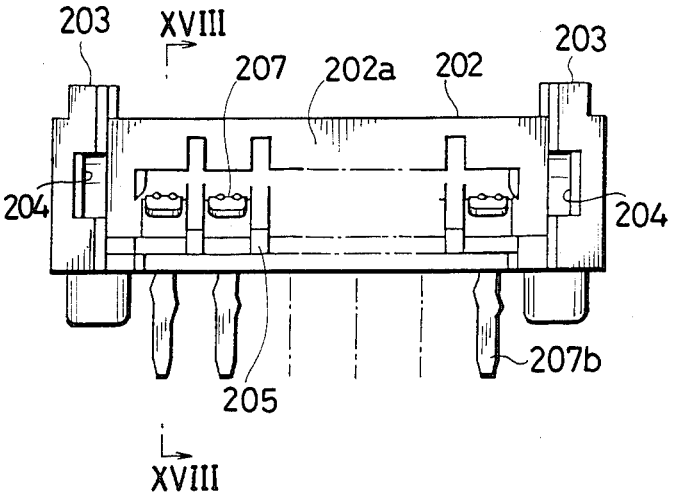
Figure 18:
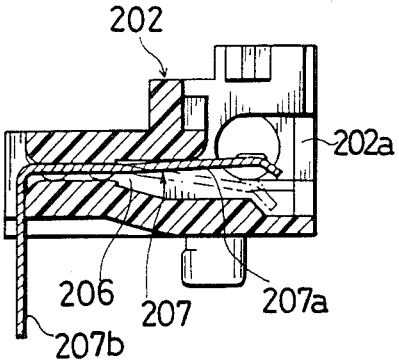

Third embodiment:

FIG. 17 and FIG. 18 show an arrangement of the second body and the second contact of a connector for a printed board connection according to the third embodiment of this invention, and wherein FIG. 17 is an explanatory illustration of the first body having an inserting recess viewed from the front side thereof, and FIG. 18 is a sectional view taken along the line XVIII—XVIII of FIG. 17.

In these drawings, numeral 202 denotes the second body integrally molded of insulating synthetic resin. This second body is a rectangular parallelopiped as a whole, and the front side and the upper side thereof are open to form a first body inserting recess 202*a*. Side walls 203, 203 are integrally formed at both ends of said first body inserting recess 202*a*, and concaves 204, 204 are formed at the inner faces of the side walls as a supporting mechanism for supporting turnably said first body. Numeral 205 is a bulk head for partitioning the mounted second contacts 207 and for reinforcing the housing of the second body. Numeral 206 is an insertion groove for inserting the second contact 207. The insertion groove 206 is provided from the back side of the second body 202 toward the front side thereof, the insertion groove is inclined downward at the middle part thereof, and the vertical interval of the insertion groove is widened.

Numeral 207 is an L-shaped second contact composed of a metal piece having resiliency such as phosphor bronze and to which plating by soldering is applied. This second contact 207 is inserted into the insertion groove 206 from the back side of the second body 202. In the drawing, a contact member 207*a* of the second contact is so arranged as to be applied urging force upwardly, and when the first body is not inserted, it is in contact with the upper side of the insertion groove 206.

Figure 19:
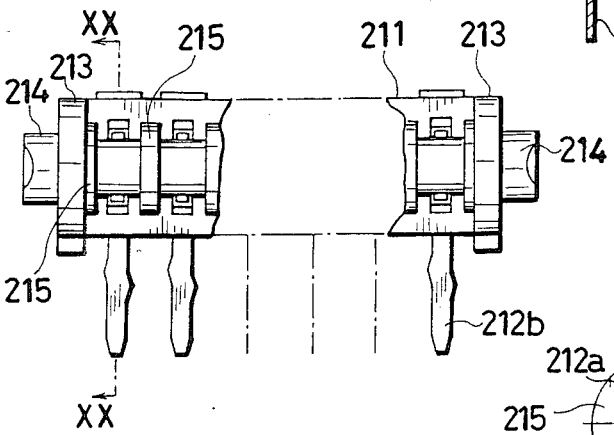
Figure 20:
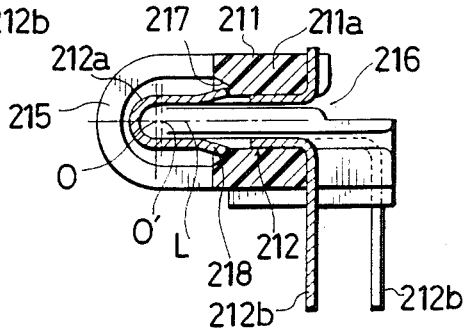

FIG. 19 and FIG. 20 show the first body to be inserted in the insertion recess 202*a* of the second body 202, and wherein FIG. 19 is a front view of the first body and FIG. 20 is a sectional view taken along the line XX—XX of FIG. 19.

In these drawings, numeral 211 is the first body in which the first contacts 212 are held at certain intervals, and this first body 211 is integrally formed of insulating synthetic resin. At both sides 213, 213 of the first body 211, shaft members 214 are provided so as to be turnably and detachably engaged with the recesses 204 of the second body. Numeral 215 is a bulk head (partition) for partitioning each of the inserted first contacts 212. An insertion groove 216 is provided at the spacing in the bulk head 215 for the insertion of the first contact therethrough. At the middle part of the insertion groove 216, a step portion 217 is vertically formed for engagement with a engaging piece of the first contact 212 described later.

Each first contact 212 is bent to be L-shaped so that the contact member 212a to be in contact with the second contact 207 may be almost symmetrical to the reference line L running through the turning center 0' of the shaft member 214 in the inserting direction of the first body. This first contact 212 is inserted in the insertion groove 216 from the back side of the first body 211. Then, a cut-and-raised piece 218 formed by cutting a part of the first contact 212 and bent to be raised is engaged with the step portion 217 formed on the insertion groove 216 so that the first contact 212 may be held on the first body 211 as shown in FIG. 20. The center 0 of the bent portion of the first contact 212 is so arranged as to be a little eccentric in relation to the turning center 0' of the shaft member 214 to the left in FIG. 20. The lead parts 212*b* of the first contact 212 conducted out of the first body 211 are bent making a right angle in relation to the inserting direction of the first body, and each of them is disposed in staggered form being displaced in the longitudinal direction. Thus, the preliminarily bent first contact 212 is inserted in the insertion groove 216 of the first body 211, thereby the first contact 212 is fitted in the first body 211, and as a result the assembling of the plug is easily carried out.

Figure 21:
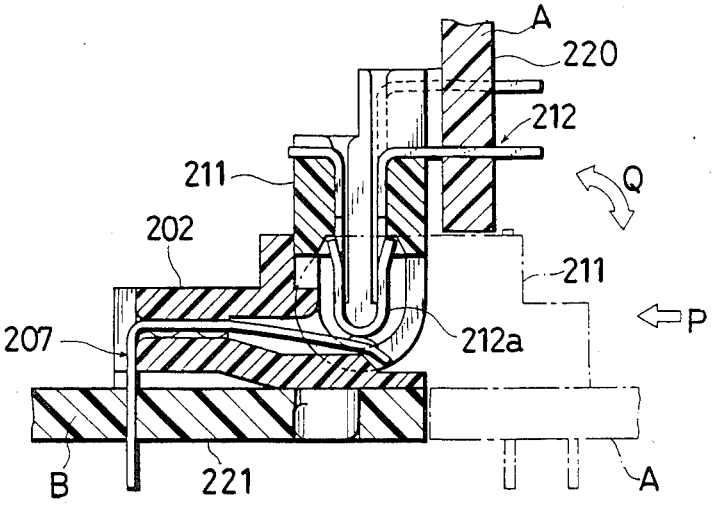
Figure 22:
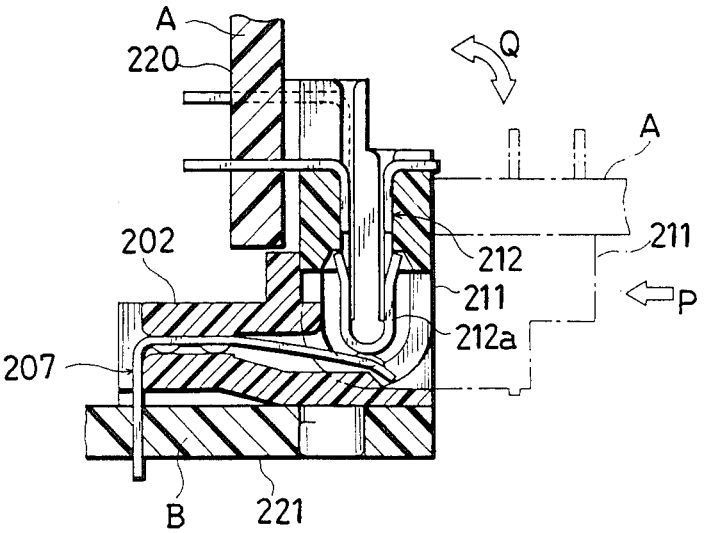

FIG. 21 and FIG. 22 are to explain a state when the contact member of the first contact disposed on the front part of the first body is inserted into the insertion recess of the second body, and wherein FIG. 22 shows a state when the upper and lower parts of the first body shown in FIG. 21 are invertedly inserted. In these Figures identical parts to FIGS. 17 to 20 are designated the same reference numerals. Characters A and B are printed boards respectively connected with the second contact of the second body and first conetact of the first body. Numerals 220 and 221 are copper foil faces of each printed board A, B.

As shown in FIG. 21, the first body 211 is inserted from the direction of arrow P and fits in as indicated by the chain line by engaging turnably the shaft member of the first body 211 with the concave 204 of the second body 202. When the inserted first body 211 is turned by 90° as indicated by arrow $\alpha$, since there is a eccentricity between the turning center 0' of the shaft 214 and the center 0 of the bent portion of the contact member 212*a* of the first contact 212 as described referring to FIG. 20, the second contact 207 coming in contact with the contact member 212*a* is pushed downward, thereby sufficient contacting pressure is obtained.

In case of FIG. 22, although the upper and lower sides of the inserting first body 211 is inverted in contrast to FIG. 21, the combination (coupling) of the first body with the second body can be effected in the same way as described referring to FIG. 21. Thus, since the inserting direction of the first body 211 can be inversely established, the copper foil faces of the printed boards can be also inversely arranged.

In this embodiment the lead part 212*b* of the first contact 212 is bent making almost a right angle to the inserting direction of the second body 202, and it is also possible to make the direction of the lead part 212*b* linear. In such case, the printed board A connected in the turned state by 90° is to be disposed in parallel to the printed board B. A further arrangement of the copper foil faces can be obtained by bending the lead part 207*b* of the second contact 207 upward shown in FIG. 18.

Figure 23:
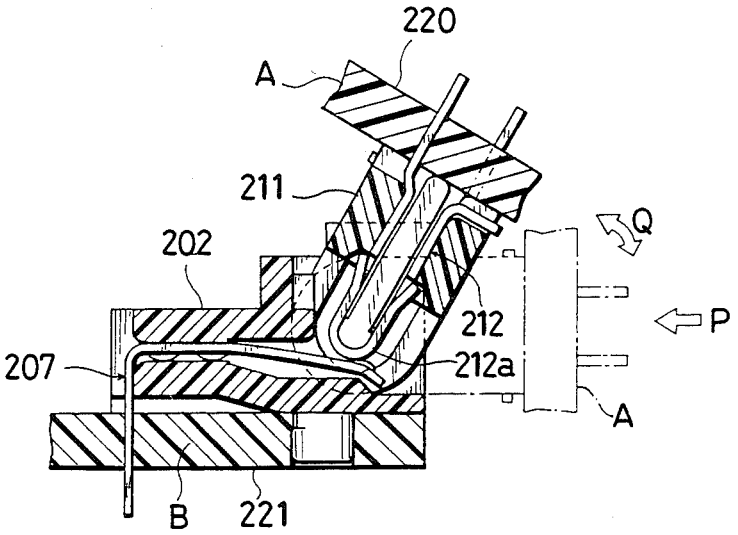
Figure 24:
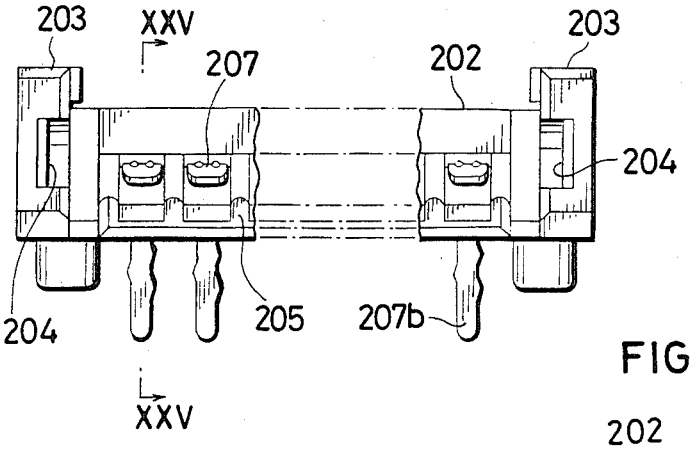
Figure 25:
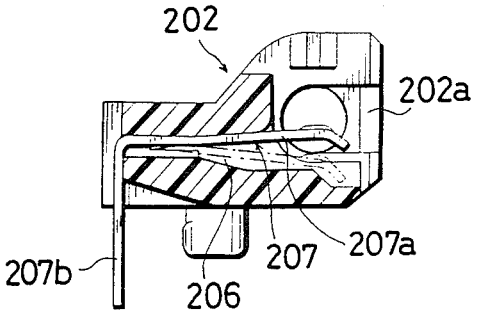

Further in this embodiment, although the first body to be inserted in the second body is turned by 90°, it is also possible to establish the turning angle to be 60° as shown in FIG. 23. By adopting such an arrangement, the insertion of printed board in a keyboard or the like becomes easier. In addition, in FIG. 23 identical parts to FIGS. 19 and 20 are designated by the same reference numerals, and the first body 211 shown therein is equipped with a linear lead part mentioned above.

As has been described so far, in case of this third embodiment, every technical advantage described in the foregoing second embodiment are achieved in the same way, and besides since the first body 211 can be coupled with the second body 202 with the upper and lower sides inverted, the copper foil faces of the printed board A, B can be freely selected outside or inside, and as a result the connector of this embodiment can be applied to various electrical appliances without being limited to a specified one.

Figure 26:
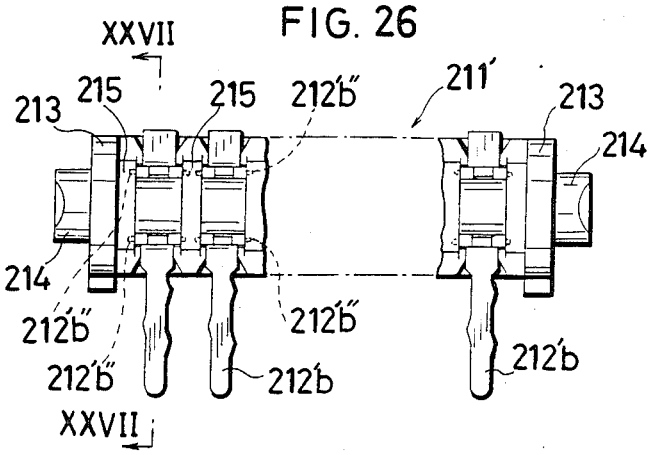
Figure 27:
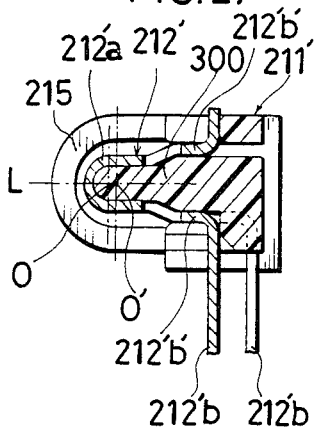

Fourth embodiment:

A connector for a printed board connection according to this fourth embodiment has several features similar to the foregoing third embodiment. However, in this embodiment, being quite different from the third embodiment, as shown in FIGS. 26 and 27, forwardly projecting supporting members 300 are integrally formed into a first body 211; i.e. inside of a plurality of bulk head (partitions) 215, 215 formed in the direction of width (lateral direction) of the first body 211', and the first contact 212' same as the first contact 212 of the third embodiment is mounted on the outside of each supporting member 300. The assembling of the first contact 212' into the supporting member 300 is carried out in the following manner. That is, in the punched first contact on which a plurality of contact members 212*a'* are arranged in parallel in the lateral direction with lead parts 212*b'* connected with each other, each contact member 212*b'* of the punched first contact is inserted together from the front side of the plurality of bulk heads 215, 215, then arrowhead-shaped pieces 212'*b''*, 212'*b''* projectingly formed on both outsides of upper and lower rear ends 212'*b'*, 212'*b'* of the contact member 212'*b* are thrusted into the left and right bulk heads 215, 215, and the inside of the contact member 212'*b* is supported by the outside of the supporting member 300.

Figure 28:
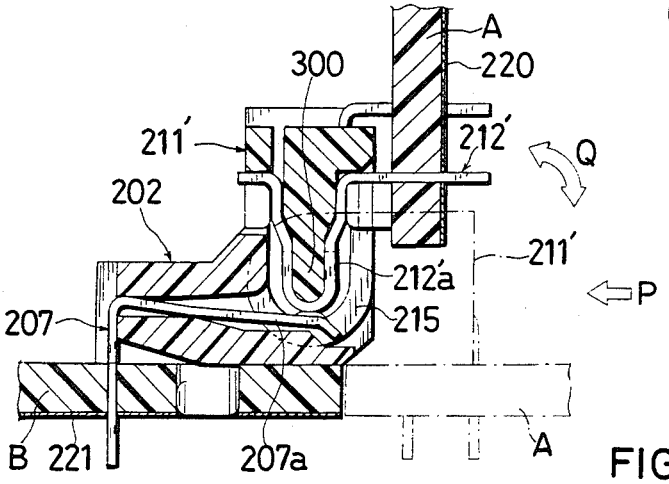
Figure 29:
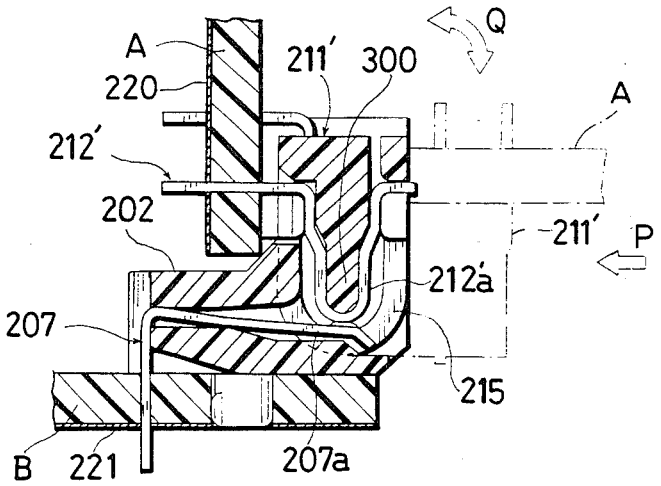

By the foregoing arrangement, a space corresponding to the dimension of the holding wall 211*a* (FIG. 20) for holding the center part of the first contact 212 is substantially saved, and therefore in comparison with the first body 211 of the third embodiment, the first body 211' of this fourth embodiment can be further small-sized. Furthermore, since the projecting supporting members 300 are integrally formed into the first body 211', as shown in FIGS. 28 and 29, even when a spring pressure is applied thereto from the contact member 207*a* of the second contact 207, section modulus in the direction against the spring pressure is increased, thereby such disadvantage is flexing in the direction of spring pressure is effectively prevented. In the case of the foregoing third embodiment, when the first body and the second body are elongated in the direction of width (lateral direction) and a large number of first and second contacts are disposed in the bodies, the first body is apt to flex in the shape of a hoop by the spring pressure from the large number of second contacts, and as a result the mutual contact between the first contact and the second contact is not performed uniformly. By adopting the above-described arrangement according to this fourth embodiment, such a problem is sufficiently prevented. Furthermore, since the first body can be elongated or extended by preventing the first body from flexing without providing a certain reinforcing wall for increasing rigidity in the direction of width of the first body, a considerably compact or small-sized connector is obtained as compared with the case wherein a plurality of first bodies are arranged in parallel to be connected with printed boards.

In addition, in this embodiment, like parts are designated by the same reference numerals as the third embodiment omitting the detailed description since there is similarity between both embodiments.

As the present invention may be embodied in several forms without departing from the spirit of the essential characteristics thereof, the foregoing embodiments are therefore illustrative and not restrictive, since the scope of the invention is defined by the appended claims rather than by the preceeding description, and all changes that fall within meets and bounds of the claims, or equivalence of such meets and bounds are therefore intended to be embraced by the claims.

What is claimed is:

1. A connector for connecting printed circuit boards, comprising:

a first body having a plurality of first contacts to be connected with a printed wiring of a first circuit board and means of the first body for mounting a first circuit board thereto, each of said plurality of first contacts comprises a fork-shaped contact member including projecting contact portions facing each other with a contact area defined on each contact portion, said contact areas being spaced apart in the projecting direction of the contact portions;

a second body facing the first contacts of said first body, said second body having a plurality of second contacts to be connected with the printed wiring of a second circuit board and means on the second body for mounting a second circuit board thereto; and means associated with each body according to which said first body and said second body are turnably and detachably connected with each other, each of said first contacts and of said second contacts being brought into contact with each other within a turning range of the two bodies.

2. A connector for connecting printed circuit boards, comprising:

a first body having a plurality of first contacts to be connected with a printed wiring of a first circuit board;

a second body facing the first contacts of said first body, said second body having a plurality of second contacts to be connected with the printed wiring of a second circuit board; and means associated with each body according to which said first body and said second body are turnably and detachably connected with each other, each of said first contacts and of said second contacts being brought into contact with each other within a turning range of the two bodies, wherein:

each of said plurality of first contacts comprises a fork-shaped contact member including projecting contact portions facing each other, each of said plurality of second contacts comprising a plate-like contact member which contacts an associated one of the fork-shaped contact members, said first body having a plurality of grooves each having an accommodating part for accommodating a respective one of said fork-shaped contact members and a spacing for permitting the top end of a respective one of said plate-like contact members to turn from above said accommodating part forward;

said top end of said plate-like contact members extending between the fork-shaped contact members which are provided at the area of the first body facing the second body in the longitudinal direction, a plurality of said plate-like contact members being fixed corresponding to said plurality of grooves, said top end of the plate-like contact member being exposed on the first body side; and said exposed top end extending into an aperture of a respective groove of the first body and further extending between the projecting contact portions of the associated fork-shaped contact member accommodated in said associated accommodating part so as to bring said top end into contact with the projecting contact portions of its associated fork-shaped contact member.

3. A connector for connecting printed circuit boards as claimed in claim 2, wherein said first body includes an insertion groove having an arcuate angle of 90° with the upper and front side open formed at both ends of the first body, said second body including a semi-circular arcuate arm portion formed at both ends of the second body for insertion into a respective one of the insertion grooves of the first body, each said arm portion including a slit-like insertion aperture, said connector further comprising a shaft member provided at the center of the arcuate angle of each insertion groove and projecting outwardly therefrom, said shaft members extending through the slit-like insertion aperture open on said arm portion so as to be engaged turnably with an engaging aperture formed on the rear end of said insertion aperture thereby allowing said arm portion to turn on said shaft member.

4. A connector for connecting a printed circuit board as claimed in claim 2, further comprising:

means on the first body for mounting the first circuit board thereto; and means on the second body for mounting the second circuit board thereto.

5. A connector for connecting printed circuit boards, comprising:

a first body having a plurality of first contacts to be connected with a printed wiring of a first circuit board; and a second body facing the first contacts of said first body, said second body having a plurality of second contacts to be connected with the printed wiring of a second circuit board, wherein:

the second body includes a housing formed as a rectangular part parallelopiped as a whole with its front side open, with an engaging aperture provided at a specified position on the left and right sides of the housing and with a plurality of cutout portions being formed on the upper side of the housing;

said first body having left and right sides for engaging detachably with said cutout portions of the second body, said connector further comprising a shaft member for engaging with each said engaging aperture of the second body, said shaft members being projectingly provided at each top end of said left and right sides of the first body;

said first body further having a ridged cam extending between the left and right sides of the first body and eccentric in the direction reverse to the engaging direction in relation to the axial center of said shaft members, said ridged cam having the first contacts mounted thereon for press contact with the second contacts of the second body; and said first body being pivoted so as to be turnable by 90° in relation to the second body while the shaft members of the first body are engaged with the engaging apertures of the second body, and each of said first contacts and of said second contacts being brought into contact with each other within the turning range of the two bodies.

6. A connector for connecting printed circuit boards as claimed in claim 5, wherein said engaging apertures of the second body are formed to be keyhole-shaped having an expanding hole on the upper part thereof, the shaft members of the first body are projectingly formed to be keyhole-shaped having a laterally expanding projection corresponding to said engaging aperture, said expanding projections being dimensioned smaller than said shaft member in the projection extent, and said expanding projections being engaged with said expanding hole while the first body assembled into the second body is turned by 90° for preventing release.

7. A connector for connecting printed circuit boards, comprising:

a first body having a plurality of first contacts to be connected with a printed wire of a first circuit board; and a second body facing the first contacts of said first body, said second body having a plurality of second contacts to be connected with the printed wiring of a second circuit board, wherein:

the second body has a first body inserting recess formed on the front side thereof, said first body insertion recess being provided at both ends of the inserting recess with a supporting mechanism for turnably supporting the first body;

the second contacts have a contact member which projects into said first body inserting recess while the second contacts are supported by the second body, each said projected contact member being urged to the turning center of the first body for displacement in a direction away from said turning center; and an engaging portion to be engaged with said supporting mechanism of the second body is formed at both ends of the first body, and the contact members of the first contacts to be brought into contact with the contact members of the second contacts are bent and disposed on the front side of the first body so as to be symmetrical to the reference line running through said turning center in the insertion direction of the first body, each of said first contacts and of said second contacts being brought into contact with each other within the turning range of the two bodies.

8. A connector for connecting printed circuit boards as claimed in claim 7, wherein said first body includes an insertion groove, and wherein said first contacts are each provided with an engaging holding piece and the insertion groove is provided with step portions, said first contacts being inserted in the insertion groove through said top end and are held by the engaging holding pieces with the step portions.

9. A connector for connecting printed circuit boards as claimed in claim 8, wherein the lead part of the first contacts is conducted out of the first body so as to be substantially orthogonal to the first body inserting direction.

10. A connector for connecting printed circuit boards as claimed in claim 9, wherein the first body further has a projecting supporting member for supporting the inner surface of the contact members of the first contacts, said projecting supporting member being integrally formed into the first body.

11. A connector for connecting printed circuit boards as claimed in claim 8, wherein a lead part of the first contacts is conducted out of the first body so as to be parallel with the first body inserting direction.

12. A connector for connecting printed circuit boards as claimed in claim 11, wherein the first body further has a projecting supporting member for supporting the inner surface of the contact members of the first contacts, said projecting supporting member being integrally formed into the first body.

13. A connector for connecting printed circuit boards as claimed in claim 8, wherein the first body further has a projecting supporting member for supporting the inner surface of the contact members of the first contacts, said projecting supporting member being integrally formed into the first body.

* * * * *

UNITED STATES PATENT AND TRADEMARK OFFICE

CERTIFICATE OF CORRECTION

PATENT NO. : 4,715,819

DATED : December 29, 1987

INVENTOR(S) : Yoshihiro Iwasa, Toru Masuda & Yasuji Shihano

It is certified that error appears in the above-identified patent and that said Letters Patent is hereby corrected as shown below:

Claim 2, column 12, line 35, "member" should be -- members --.

Claim 5, column 13, line 9, "part" should be cancelled.

Signed and Sealed this

Ninth Day of August, 1988

*Attest:*

DONALD J. QUIGG

*Attesting Officer*

*Commissioner of Patents and Trademarks*